US006090756A

United States Patent [19]

Brown

[11] Patent Number: 6,090,756

[45] Date of Patent: Jul. 18, 2000

[54] BALLISTICS CONDITIONING WITH MOLYBDENUM DISULFIDE

[75] Inventor: David Thomas Brown, 2018 Walburg Rd., Burlington, Wis. 53105

[73] Assignee: David Thomas Brown, Burlington, Wis.

[21] Appl. No.: 09/105,566

[22] Filed: Jun. 26, 1998

Related U.S. Application Data

[60] Provisional application No. 60/053,014, Jun. 26, 1997.

[51] Int. Cl.[7] ..... C10M 125/00; C10M 107/00

[52] U.S. Cl. ..... 508/118; 508/129; 508/131; 508/155; 508/167; 102/511; 427/407.1; 427/419.7

[58] Field of Search ..... 508/118, 167

[56] References Cited

U.S. PATENT DOCUMENTS

| | | | |
|---|---|---|---|
| 2,442,155 | 5/1948 | Weese | 102/92.5 |
| 3,249,538 | 5/1966 | Freier | 252/18 |
| 3,390,080 | 6/1968 | Groszek | 252/25 |
| 3,909,424 | 9/1975 | Clark | 252/12 |
| 4,066,605 | 1/1978 | McBride et al. | 260/37 EP |
| 4,196,670 | 4/1980 | Vastvog | 102/92.2 |
| 4,239,006 | 12/1980 | Kelson | 102/93 |
| 4,328,750 | 5/1982 | Oberg et al. | 102/514 |
| 4,454,175 | 6/1984 | Martin | 427/242 |
| 4,465,883 | 8/1984 | Lopata et al. | 585/9 |
| 4,731,189 | 3/1988 | Gregg, Jr. . | |
| 4,808,324 | 2/1989 | Periard et al. | 252/23 |
| 4,858,534 | 8/1989 | Wallace | 102/511 |
| 5,062,974 | 11/1991 | Van Meter | 252/11 |
| 5,233,128 | 8/1993 | Lai | 102/511 |
| 5,341,744 | 8/1994 | Shi | 102/442 |
| 5,372,154 | 12/1994 | Bee et al. | 134/110 |
| 5,378,499 | 1/1995 | Martin et al. | 427/242 |

OTHER PUBLICATIONS

Dow–Corning Publication, "Illustrated Mechanism of Molybdenum Disulfide Lubrication." (no date).

D. Brennan, "Norma Introduces Moly–Coated–Bullet–Target–Cartridge Line," Precision Shooting, pp. 19–21, Aug. 1995.

Letter to the Editor or Precision Shooting, p. 5, Feb. 1996.

C. F. Young, "Moly–Lube, a Tried and Tested Art," Precision Shooting, pp. 63–71, Aug. 1996.

M. L. McPherson, "So Just Exactly How Does a Barrel Wear Out?," Precision Shooting, pp. 94–96, Nov. 1996.

C. F. Young, "MolyGrease—The Sequel," Precision Shooting, pp. 67–75, Dec. 1996.

L. Elliott, "Moly Coating, A New Revolution," The Varmint Hunter, Issue 22, pp. 161–167, Apr. 1997.

Information About Dow Corning Z–Moly–Powder, product information from Dow Corning Customer Service, Midland, Michigan.

"'Moly' The Super Lubricant," description of "Fastart" lubricant, downloaded from the Internet site of Beslub International Ltd. on May 10, 1997.

David Brown, Moly—And It's Application for Ballistics Use, Shooter's News, pp. 34–42, Nov. 1997.

K–G Products "Bullet Kote" molybdenum disulfide bullet coating formulation product information downloaded from the Internet Jun. 12, 1998.

K–G Products "KG–6 Moly Bore Prep" molybdenum disulfide formulation for embedding a thin moly film on the bore of a rifle. Product information downloaded from the Internet Jun. 12, 1998.

Label: "Saf–T–Eze Dry–Moly," STL Compound Corporation, Lombard, IL 60148.

"Neco–Coat Bullet Moly Coating," pp. 3–10.

*Primary Examiner*—Ellen M. McAvoy
*Attorney, Agent, or Firm*—Jerry F. Janssen

[57] ABSTRACT

The present invention provides compositions and methods for the coating and/or ballistics conditioning of firearm projectiles and firearm components including gun barrels, firearm chambers, fully assembled cartridges, shot gun shells, shotgun wads, shot capsules and sabots with molybdenum disulfide. The composition comprises powdered molybdenum disulfide suspended in a carrier comprising a volatile solvent and a binder selected from cellulosic-, alkyd- and acrylic-resins. Methods for the conditioning of firearm bores by the formation of a hardened layer comprising a product of the reaction or interaction of molybdenum disulfide with materials in the barrel bore are also disclosed.

39 Claims, 7 Drawing Sheets

BALLISTICS CONDITIONING WITH MOLYBDENUM DISULFIDE

CROSS-REFERENCE TO RELATED APPLICATIONS

This application claims priority to Provisional Application Ser. No. 60/053,014 filed Jun. 26, 1997.

TECHNICAL FIELD

This invention relates to protective and lubricating coatings for metals. More particularly the invention concerns compositions and a method for applying a dry protective and lubricating surface coating to firearms, firearm components, and to firearm ammunition and ammunition elements.

BACKGROUND OF THE INVENTION

It has long been recognized in the ballistics field that slightly oversized projectiles engage the undersized bores of firearms through which they pass on firing and cause fouling. Firing frequently heats the bullet to the softening and perhaps the melting point and also heats the firearm barrel through which the projectile is fired. Microscopic surface defects or irregularities in the barrel increase frictional forces and remove minute metal particles from the projectile. These particles become imbedded on the inner bore surface of the firearm barrel.

Projectiles are generally manufactured of materials much softer, malleable and with a much lower melting point than barrel alloy. Upon being fired, the projectile will conform to the dimensions of the interior surface of the barrel. Typically firearm projectiles are made of cast/swaged lead bullets, jacketed bullets with a copper outer jacket and a soft lead core swaged into the copper jacket or, in the case of shot guns, pellet shot which is usually carried in a plastic "wad" or capsule.

The heat of powder and primer ignition and the heat of friction during the internal ballistic experience is tremendous for a few milliseconds. Barrel alloys get very hot and projectiles get so hot that they begin to soften, flow or melt on their trip down the barrel.

The rough, microscopic surface asperities of the bullet and barrel surfaces mutually abrade each other and minute particles of projectile surfaces are typically transferred by this abrasive action, heat and pressure from the projectile surface to the bore surface. In the early stages, the problem of this build-up on the bore surfaces from minute particles from the bullets is called "copper or lead wash". As the metallic build-up becomes more severe, such buildup is known as "copper, lead or plastic fouling".

It is well known that metallic fouling and foreign material in firearm barrels adversely affects firing accuracy. Metallic fouling irregularly alters the internal dimensions of the bore. Bullets passing over these irregularities, being altered by heat and pressure to conform to these irregularities, cause the bullets to become irregular and out of symmetry and thereby out of balance. This asymmetrical condition causes the bullet to yaw and wobble irregularly during flight from one shot to the next, and accuracy is diminished. Foreign debris of powder and primer residue, carbon, dirt and grit become abrasive and create irregular wear patterns on the relatively soft barrel alloy, similarly contributing to a decrease in accuracy.

This problem has been addressed with varying degrees of success by many inventors by using various lubricants including waxes, greases, soaps and dry lubricants applied to bullets and/or firearm bore surfaces. Oils and greases do not adhere well to the bullets or bore surfaces and may pick up abrasive dirt, dust and grit, or break down into acidic and corrosive agents. Under the extreme temperatures and pressures associated with firing they typically are burned off and do not add much lubrication or protection against corrosion. To the contrary, their waste products typically contribute further to the fouling problem.

Moreover, a safety hazard may be created with greases or oils in the barrel when these fluid lubricants are "snow plowed" ahead of a fired projectile as it travels down the firearm barrel. The resulting tremendous hydraulic pressure effects cause pressure excursions that will bulge or burst barrels and blow up the locking mechanism.

U.S. Pat. No. 4,858,534 to Wallace discloses the use of a lubricating composition comprising a polyolefin-base oil, amorphous silicon dioxide, and disodium octaborate tetrahydrate disposed in an indented ring around a bullet for lubricating firearm barrels through which such bullets are fired.

To avoid the use of oil- and grease-type lubricants, various solid lubricants have been suggested in the prior art. It is known, for example, among the elite of competition shooters that the use of 0.22 or 0.243 caliber bullets dry-coated with a lubricating layer of powdered molybdenum disulfide are effective in reducing the degree of metallic fouling to the extent that cleaning may not be required during a rifle match in which about 100 shots are fired. Normally, these small caliber bullets have a full metal jacket or hollow points with no lead exposed on the bullet nose. Typically these bullets are fired through expensive premium grade barrels on match rifles, the bores of which have been lapped and polished. These competitive shooters have noticed that the consistent use of powdered molybdenum disulfide coated bullets has extended barrel life.

Molybdenum disulfide is available as a dry powder of more or less 98–99 percent by weight molybdenum disulfide, generally three grades, ranging in average particle sizes from 2–63 microns. A typical product is available from Dow Corning Company, Midland Mich., as Dow Corning "Z Moly-Powder." Molybdenum disulfide has been applied as a dry powder lubricant to the sliding surfaces of metal equipment. FIG. 4 shows a magnified illustration of molybdenum disulfide particles, showing that the molybdenum disulfide particles consist of conglomerates of many small flakes which give the particles a gross appearance of being generally round or clam-shell shaped.

Figure 7:
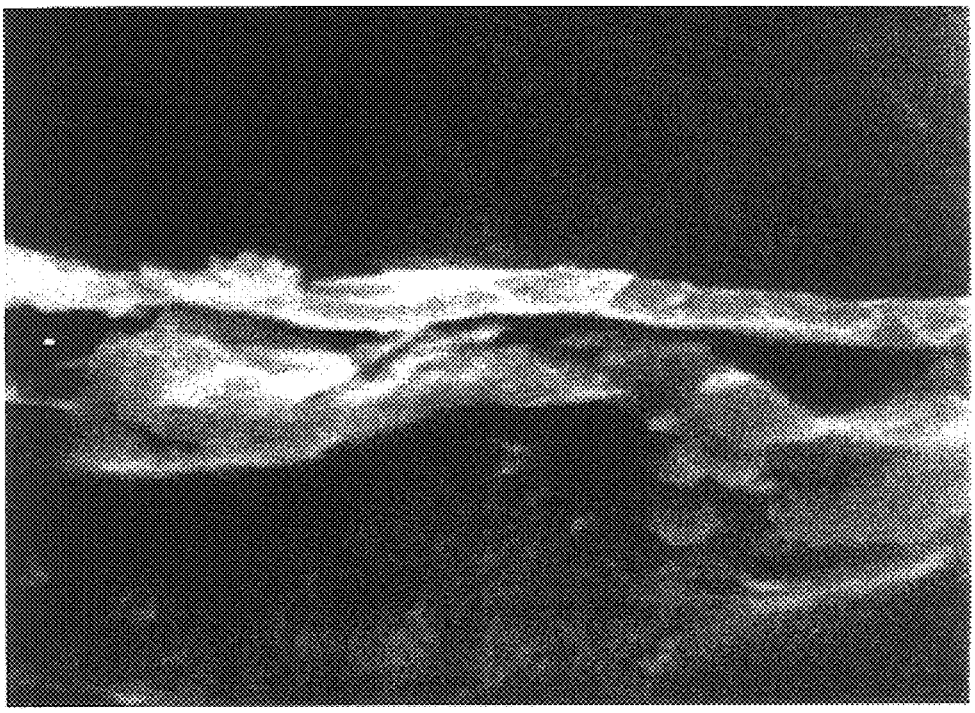

Thus, the "crushing" of the particles by the steel ball spreads the respective particles out over a greater portion of the underlying metal surface, with overlap of the respective thus enlarged particles, thus to make a quasi-layer comprising the overlapped particles, as illustrated in plan view in FIG. 7. FIG. 7 shows in enlarged cross-section, however, that the ovrlying layer of molybdenum disulfide does not fill the valleys lying between the peaks of the asperities on the substrate surface.

Thus, in dry-applied molybdenum disulfide, it appears that there is less, or poorer, bonding between particles than between lamella within a given particle, whereby the protective, metal conditioning layer is subject to being rubbed off the underlying metal surface which it is intended to protect.

It is clearly seen in FIG. 7 that the layer "a" of molybdenum disulfide touches the underlying surface only at peaks of the asperities of the underlying surface, and otherwise is generally spaced from the underlying surface at the valleys. Thus, the dry-coated layer of molybdenum disulfide provides interfacial contact with the underlying surface of the metal substrate only at the peaks, whereby the load/pressure between two metal surfaces so conditioned by such a layer is concentrated at the peaks, and is thus not spread out over the entire area of the underlying metal surface. Further, FIG. 7 shows major cracks "b" extending entirely through the thickness of the molybdenum disulfide layer "a," further illustrating the ability of the layer "a" to break up and flake off the metal surface.

While some success has been seen with the coating of smaller caliber target bullets with dry, powdered molybdenum disulfide, less success has been seen with the application of powdered molybdenum coating to larger bullets fired at greater velocities from higher powder capacity cartridges such as those employed in hunting-type bullets fired from mass production hunting rifles. Because of this limited success, the practice of using dry, powdered molybdenum disulfide to coat bullets is not widely accepted and is limited primarily to the competitive shooting fraternity. The reason for this lack of success in larger bullets is primarily due to the fact that with powdered molybdenum sulfide coating of bullets the maximum build of the coating is about 0.00005 inch (0.0013 mm). There is thus generally not enough molybdenum disulfide adhering to the bearing surface of the bullet to survive the transit in the rougher barrels of mass produced rifles. Thus, metallic fouling persists, in such applications requiring the regular and standard regimen of cleaning of the firearm barrel, typically with abrasive mechanical brushing and strong chemical solvents and/or polishing/cleaning compounds. The benefits to the hunter and non-competitive shooter are not great enough to justify the added cost of time and material of applying the powdered molybdenum disulfide.

Various methods have been suggested for applying a layer of dry powdered molybdenum disulfide to the surface of bullets which permits a more uniform and more adherent layer.

U.S. Pat. No. 4,454,175 Martin teaches a method of impact plating the surfaces of lead bullets with powdered molybdenum disulfide which comprises the steps of tumbling the bullets in a ball mill containing powdered molybdenum disulfide and steel shot. The process is applicable only to bullets and cannot be utilized for coating bullets in a fully loaded cartridge or for conditioning the inner bore of a firearm barrel. For the latter purpose, Martin, et al. teach in U.S. Pat. No. 5,378,499 the lapping of the bore of a firearm barrel by firing through it bullets which have been previously coated with an abrasive such as diamond powder, boron nitride, boron carbide, silicon carbide, and the like.

To overcome the drawbacks associated with coating bullets with dry, powdered molybdenum disulfide, various methods have been suggested in the prior art which employ liquid compositions comprising molybdenum disulfide.

U.S. Pat. No. 4,196,670 to Vatsvog, for example, teaches a process for uniformly coating bullets with molybdenum disulfide lubricant by spray or dip coating the bullets with a suspension of molybdenum disulfide in an epoxy phenolic resin. The patentee teaches that the wet-coated bullets are then allowed to air dry. For an effective and rapid cure of epoxy phenolic resins, however, the resin coating should be heat cured. If the coating is allowed to air dry as taught by the patentee, this process suffers from the disadvantage of requiring long cure times before the coating is ready for its intended use.

U.S. Pat. No. 5,062,974 to Van Meter discloses a surface treatment for firearms and bullets comprising finely divided molybdenum disulfide, an alkali metal molybdate and a volatile organic solvent such as trichloroethane. The patentee teaches that the sodium molybdate adheres to the underlying metal substrate, with the molybdenum disulfide adhering to the sodium molydate.

The methods taught in the prior art for coating firearm projectiles or conditioning the inner bore of a firearm barrel, however, do not adequately address the problem of how to effectively and conveniently apply molybdenum disulfide to bullets, and to condition firearm bores and reloading components to remedy these conditions of fouling, cleaning, corrosion, and erosion in a cost effective way.

Thus it is one object of the present invention to provide compositions and methods for applying a desired amount of a bonded molybdenum disulfide composition as a coating to bullets and firearm components.

It is another object of the invention to provide compositions and methods for applying a desired amount of a molybdenum disulfide composition as a bonded coating on other ballistics apparatuses such as gun barrels, firearm chambers, fully assembled cartridges, shotgun wads, shot capsules and sabots.

It is yet a further object of the invention to provide compositions and methods that effectively degrease the surface of the substrate material to be coated in preparation for the process of applying the molybdenum disulfide coating, such that the degreasing and coating are performed in a single step of applying coating material while preparing that substrate material surface for coating.

It is a further object of the invention to provide compositions and methods that readily, easily, cost effectively harden the interior barrel alloy surfaces of a firearm such that erosion of the barrel surface is minimized and that the useful life of the barrel is greatly extended.

It is yet another object of the invention to smooth the interior surface of the barrel to eliminate or minimize fissures, pitting, ruptures of the alloy surface.

It is another object of the invention to provide compositions and methods that readily, easily, cost effective repairs, heals, mends and restores to a considerable extent the fissured, eroded, degraded surfaces of used firearms.

It is also another object of the invention to provide compositions and methods that readily, easily, cost effectively protect the interior and exterior surface alloy of firearms from corrosive elements such as water, salt water, powder and primer corrosive by-products, environmental acids and solvents.

It is also another object of the invention to provide an environmentally safe protective coating to lead and other metallic shot such that will not degrade to produce lead products in environmental wetlands and in the digestive tracts of waterfowl.

It is also another object of the invention to provide a surface buffering zone to exterior surfaces of metallic bullet components to prevent oxidation, corrosion, etc. by applying $MOS_2$ to the product surfaces before, during and after steps in the manufacture of swaged lead wire and molded lead bullets, bullet molds, sheet copper, copper billets, copper wire, in jacketed bullets, to molded/extruded plastics in shot wads, and ferrous alloys in firearm barrels, actions, and other components.

It is the final object of the invention to provide compositions and methods that readily, easily, and cost effectively minimizes or eliminates the frequent need for a cleaning process to remove metallic fouling, carbon and powder residue fouling and corrosion in firearms.

BRIEF DESCRIPTION OF THE DRAWING FIGURES

Figure 1:
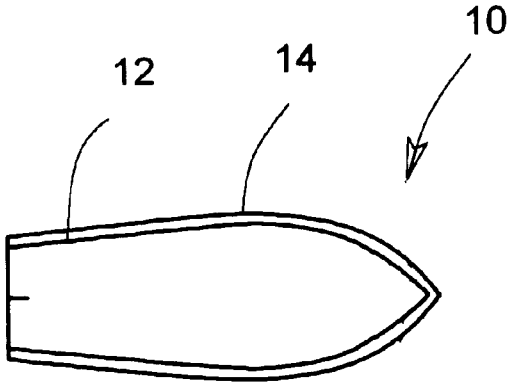

In the drawing:

FIG. 1 shows a representative cross-section of a bullet coated in accordance with the invention.

Figure 2:
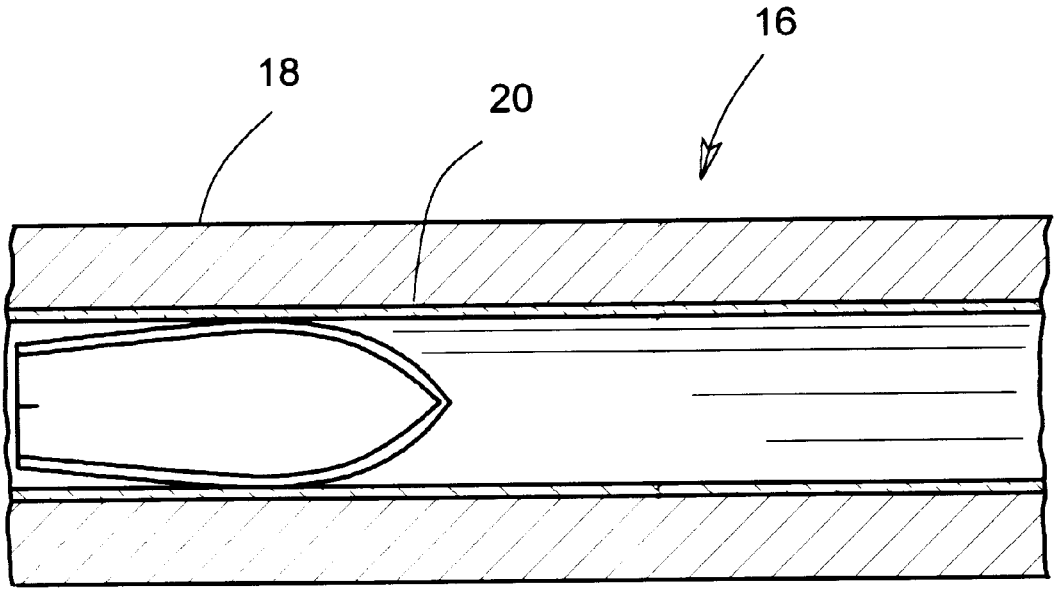

FIG. 2 shows a representative across section of a bullet coated according to the invention, in combination with a gun barrel coated according to the invention.

Figure 3:
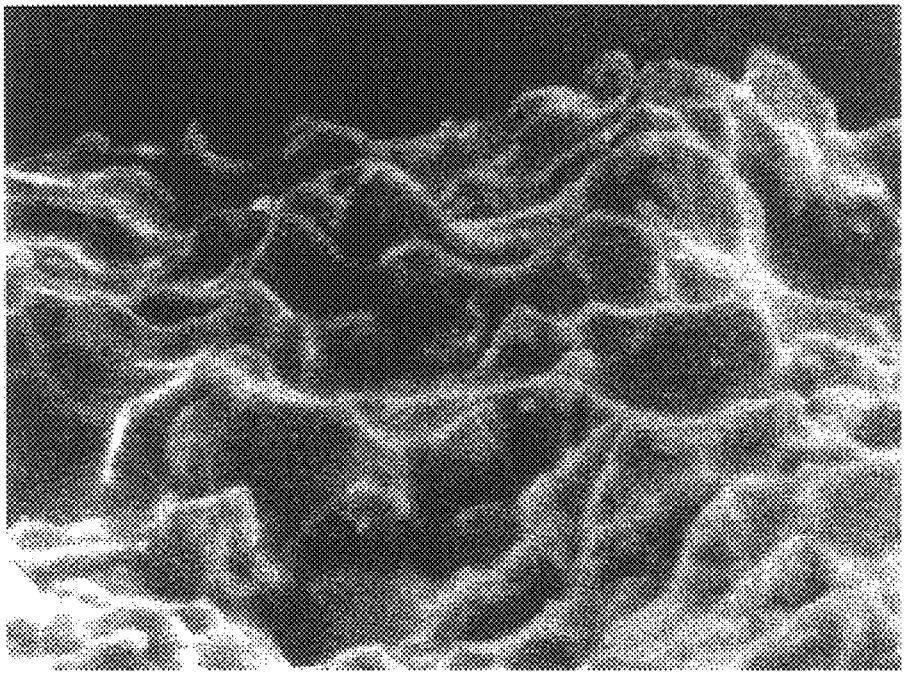

FIG. 3 shows a magnified view of the surface of a polished metal.

Figure 4:
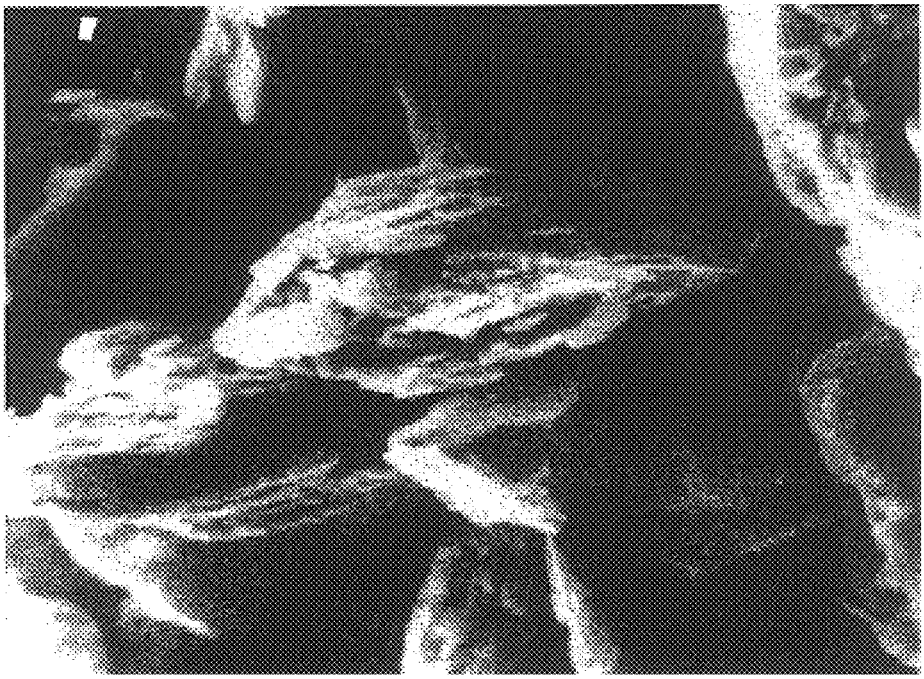

FIG. 4 shows magnified view of the rounded, clam-shell shaped particles of powdered molybdenum disulfide also showing the layering of particle platelets with their definite lines of lamination and/or definite lines of cleavage.

Figure 5:
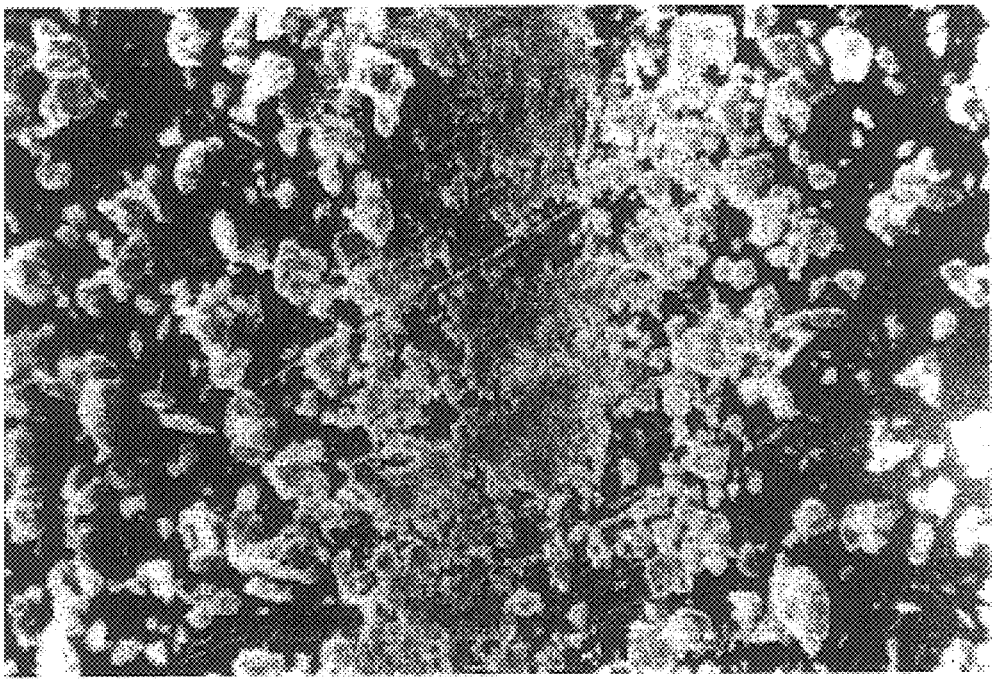
FIG. 5 illustrates the response of the molybdenum disulfide particles coated on a metal substrate when a steel ball slides over the surface onto which the molybdenum disulfide has been sprinkled. As shown therein, the particles are flattened and adhere very strongly to the underlying surface of the metal substrate.

FIG. 5 shows a magnified view of the powdered molybdenum disulfide particles of FIG. 4 after a steel ball slides over the particles, flattening them into more intimate contact with the substrate.

Figure 6:
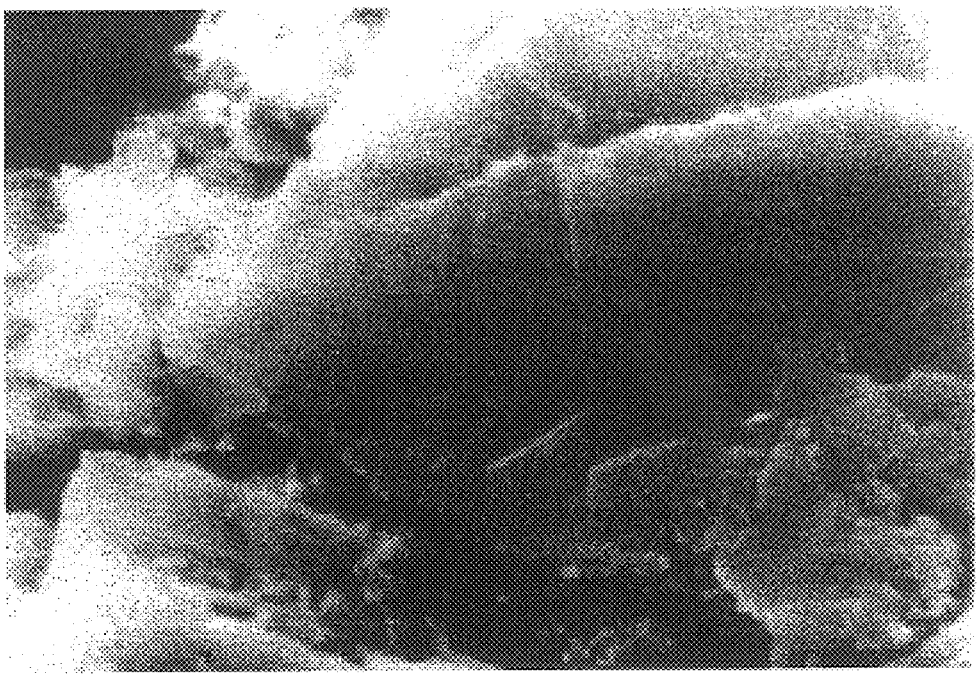
FIG. 6 illustrates, that the mechanical stress induced by the ball has produced flat planes from the round grains, and wherein the lamella layers of the molybdenum disulfide of any given particle has been more or less shingled, thus to provide a thinner, plate-like particle having a larger surface area.

FIG. 6 further illustrates a magnified view of the flattened lamallae of FIGS. 5, showing the mechanical overlapping (shingling) of the planes of the particles upon one another as they disperse horizontally with applied lateral pressure. The flattened lamallae thus act to somewhat close the spaces between the particles and to fabricate a dry-formed layer.

FIG. 7 shows, in cross-section, a layer of molybdenum disulfide overlaying a metal substrate surface. As can be seen in the Figure, the molybdenum disulfide layer rests, for the most part on the "peaks" of the underlying substrate surface, leaving unfilled "valleys" between.

Figure 8:
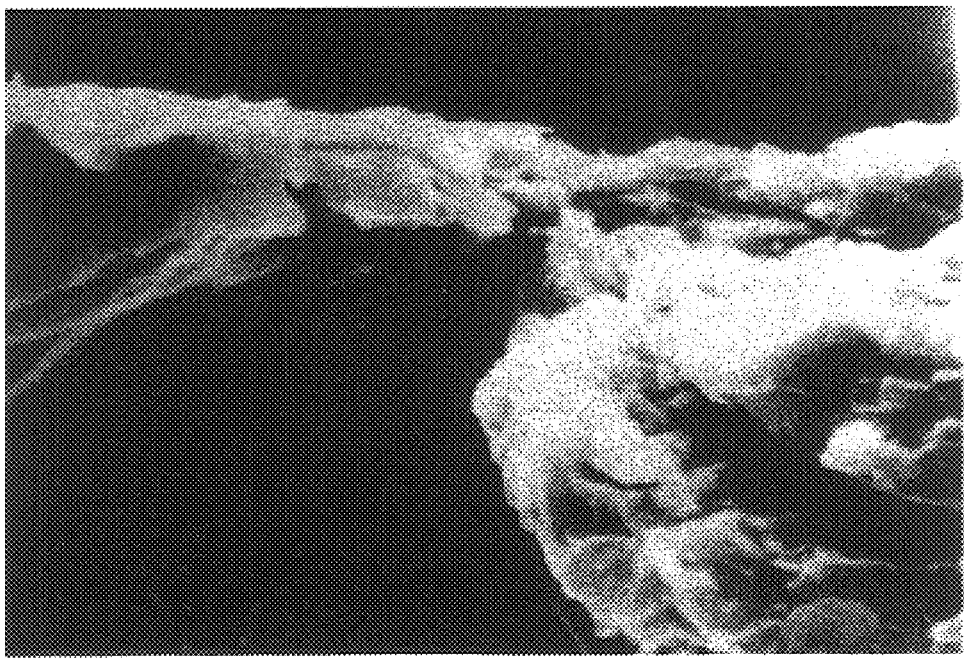
Figure 9:
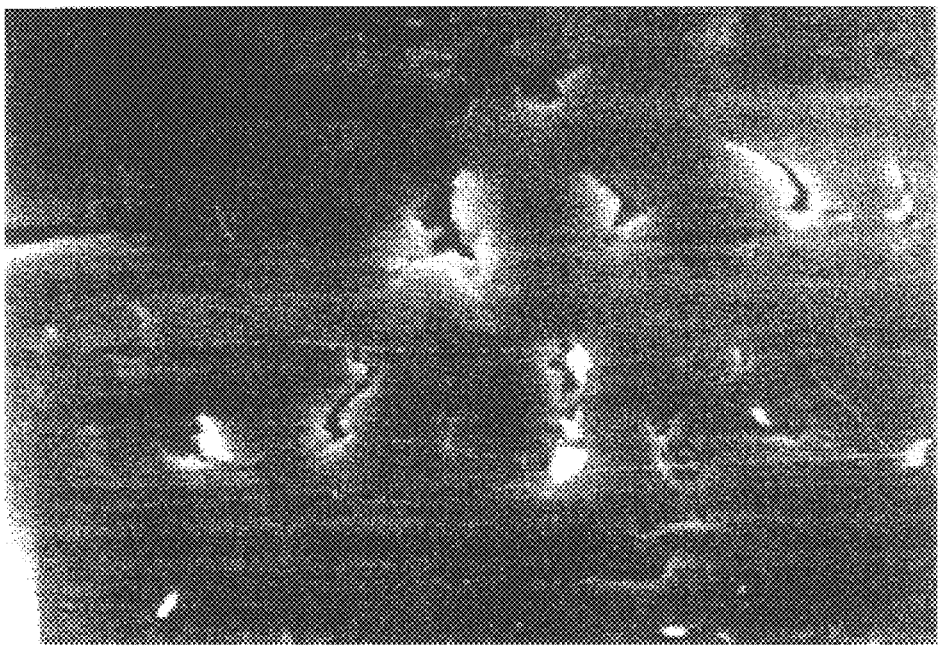

FIG. 8 shows a cross-section of the substrate metal and the overlaying dry-formed molybdenum disulfide layer of FIG. 9 and shows the molybdenum disulfide intruding own into the aspereities and into the underlying crystal structure. Notice the sharp, crag asperity in center.

FIG. 9 shows the metal surface of a wire subjected to being drawn through a reducing die, similar to the action of forcing an oversize bullet through a firearm barrel under great heat and pressure. Notice the splits, pits, and wear marks (striations) on the metal's surface.

Figure 10:
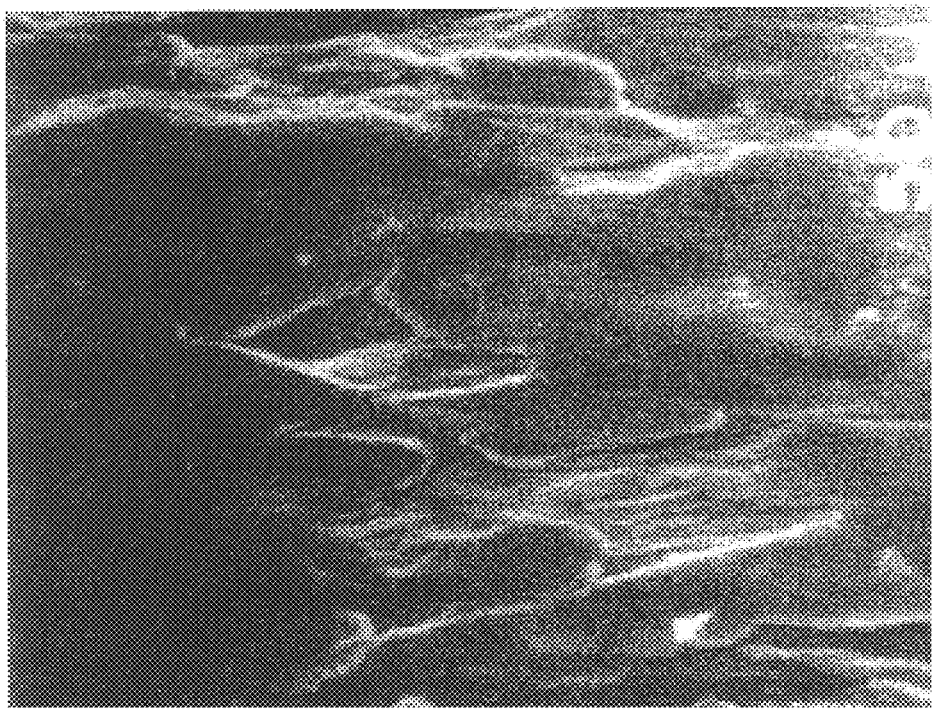

FIG. 10 shows the same material of FIG. 10, but having been previously coated with a smooth coating of molybdenum disulfide.

Figure 11:
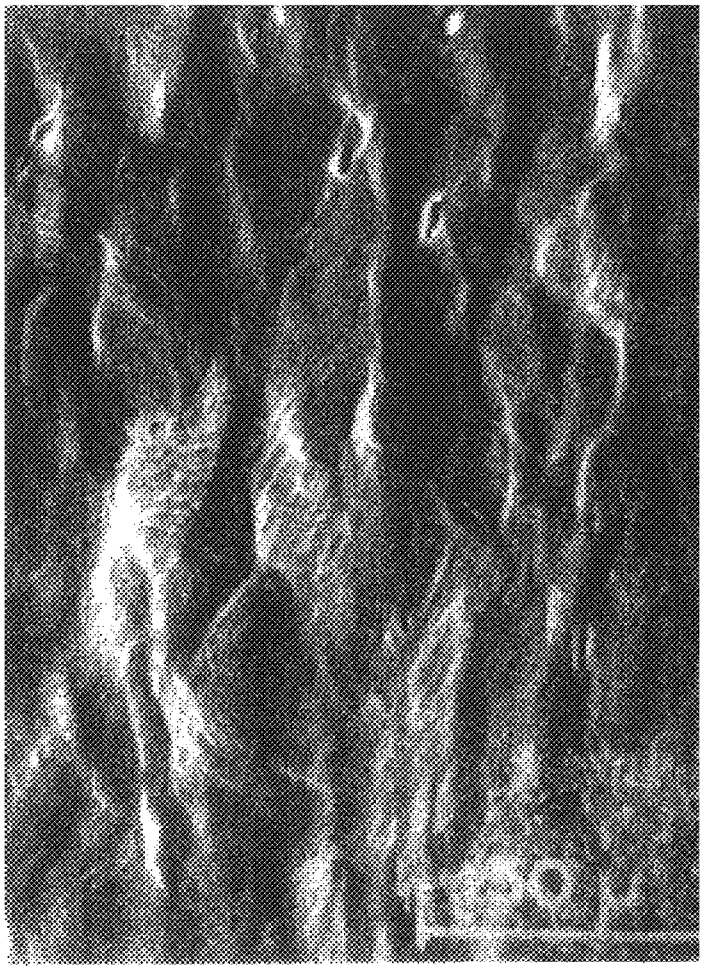

FIG. 11 shows the same metallic surface of FIG. 10 after having been passed through a drawing die or similar operation. This process is analogous to the passage of a bullet through a rifle bore, hence the figure illustrates how the bore surface would appear. Splits, tears, and pits in the surface are no longer to be seen, a the molybdenum disulfide coating buffers the metallic surface. The surface is thus smoother than that in FIG. 9 (uncoated surface).

Figure 12:
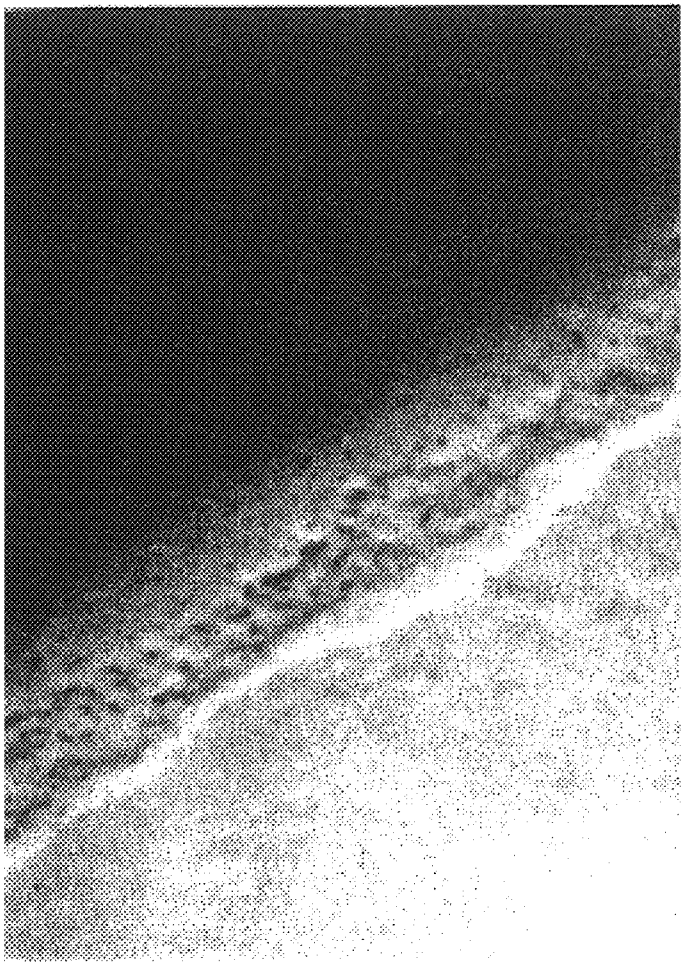

FIG. 12 shows in cross section of a carbide rich, hardened, intermetallic zone of a metallic surface. The dark spots illustrate the presence of the carbides.

Figure 13:
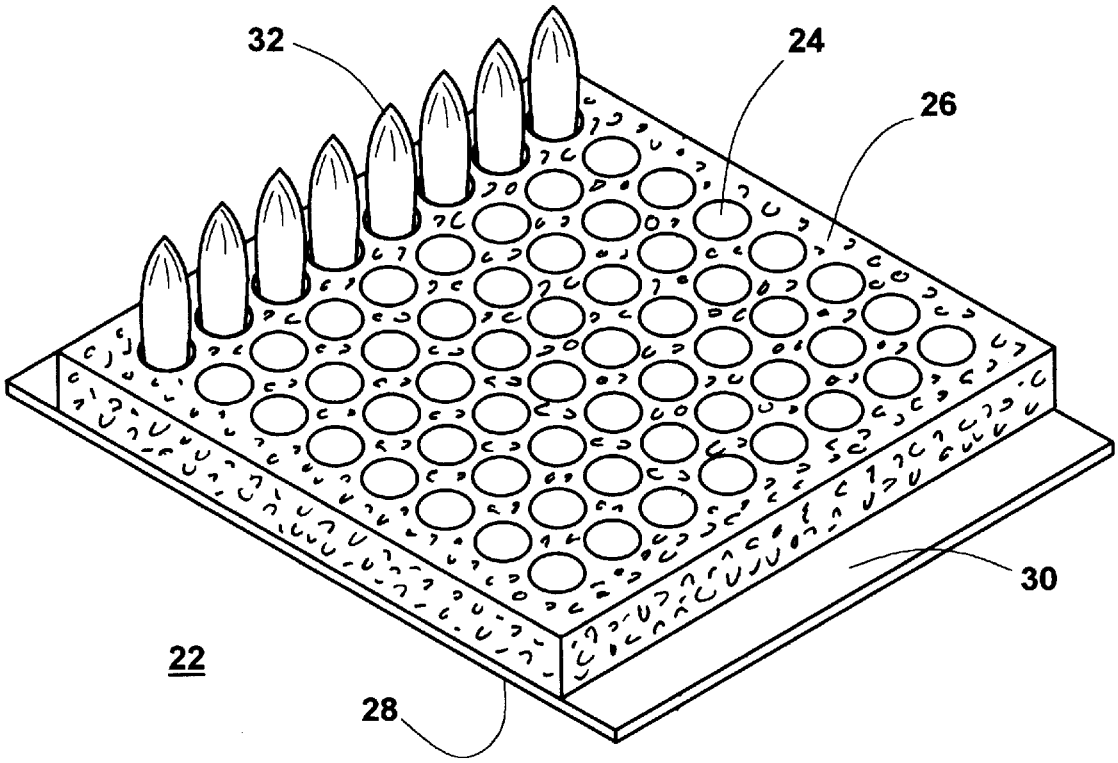

FIG. 13 shows a perspective view of an organizer useful for placing bullets upright in close array for quick and easy spray-coating in accordance with one embodiment of the invention.

SUMMARY OF THE INVENTION

These, and other objects are achieved by the present invention which provides, in one embodiment, compositions for the ballistic conditioning of firearms, firearm components, bullets and loaded ammunition cartridges comprising a suspension of powdered molybdenum disulfide in a vehicle comprising a volatile solvent and a binder selected from the group consisting of quick-drying cellulosic, alkyd, and acrylic resins, and mixtures thereof.

In another embodiment, methods of coating articles comprising firearm projectiles and firearm components including gun barrels, firearm chambers, fully assembled cartridges, shot gun shells, shotgun wads, shot capsules and sabots with molybdenum disulfide are provided.

In yet another embodiment of the present invention, there is provided a method of ballistically conditioning the bore of the barrel of a firearm, including rifles, shotguns and hand guns, by applying a coating of a composition of powdered molybdenum disulfide in a vehicle comprising a volatile solvent and a binder selected from the group consisting of quick-drying cellulosic, alkyd, and acrylic resins, and mixtures thereof to the bore of the barrel of a firearm and subsequently heating the barrel to a temperature sufficient to cause the molybdenum disulfide to interact or react with components in the barrel to form a hard surface on the bore of the firearm barrel.

The invention is not limited in its application to the details of construction and the arrangement of the components set forth in the following description or illustrated in the drawings. The invention is capable of other embodiments or of being practiced or carried out in various ways. Also, it is to be understood that the terminology and phraseology employed herein is for purposes of description and illustration and should not be regarded as limiting.

DETAILED DESCRIPTION

Referring to FIG. 1, a coated bullet 10 in accordance of the present invention includes an underlying metal bullet substrate 12 coated with an overlying and firmly adhered first layer 14 comprising molybdenum disulfide ($MoS_2$).

FIG. 2 shows bullet 10 inside a gun barrel 16. Gun barrel 16 has an underlying metal barrel substrate 18 and a second layer 20 comprising molybdenum sulfide. In both cases, as illustrated, the molybdenum disulfide layers 14 and 20 are applied and bonded directly to the underlying metal substrates 12 and 18 respectively using a composition comprising powdered molybdenum disulfide in a carrier comprising a volatile solvent and a rapid air-drying cellulosic, alkyd, or acrylic binder or combination thereof.

The composition of the carrier is selected such that it performs a variety of functions. First, the carrier is a suspending agent, acting to suspend the molybdenum disulfide for at least sufficient time to allow for effective application of the suspension to the substrate surface being conditioned.

Second, the carrier operates to disperse the molybdenum dislufide particles/platelets evenly in the formulation, to obtain a relatively uniform spray dispersion of molybdenum disulfide as it is applied to a substrate, and to encapsulate each molybdenum disulfide particle with binder on the substrate surface, assuring adherence to the surface.

Third, the carrier has sufficiently fluidity, and sufficient surface tension, with respect to the surfaces to which the molybdenum disulfide is to be applied, that the carrier quickly flows to uniformly cover the substrate surface with a uniform liquid film before the carrier solvent evaporates to thereby leave behind a respective uniform and unitary layer of molybdenum disulfide and binder on the surface of the substrate.

Fourth, the carrier solvent has a sufficiently high volatility that the solvent evaporates within a matter of a few seconds after the liquid suspension has been applied to the substrate surface, preferably within no more than five to fifteen seconds at a temperature of at least about 100° F. (~37.8° C.).

Fifth, the resin binder contained in the carrier should have a sufficiently low thermal setting point that it rapidly dries and cures at ambient temperatures or temperatures slightly above ambient.

With the above desirable properties of the carrier in mind, a suitable coating composition is made in accordance with the present invention by suspending about 0.5 lb (0.23 kg) to about 1.2 lb (0.54 kg), of powdered molybdenum disulfide in about 1 gallon (3.79 L) of a mixture of solvents and binder resin.

The molybdenum disulfide used in such compositions has an average particle size below about 8 microns, preferably ranging between about 2 to about 6 microns and is available commercially, as for example from Dow Corning, Midland, Mich., U.S.A. as Dow Corning "Z Moly-Powder".

Suitable solvents for use in the formulations of the present invention include solvents known to those skilled in the paint and coatings arts. These include hydrocarbons such as $C_1$–$C_{10}$ alkanes, toluene, xylenes and the like; alcohols such as ethanol, n-propanol, iso-propanol, butanol, and the like; esters such as ethyl acetate, butyl acetate, dibutyl phthalate, cellosolve acetate, Monsanto PolySolv® EE acetate, and the like; and ketones such as acetone, methyl isobutyl ketone (MIBK), and the like.

The binder resin utilized in the coating formulations of the present invention is selected from the families of cellulosic-, alkyd-, or acrylic-based resins and mixtures of these families which dry and cure rapidly at temperatures at or slightly above ambient to produce a uniform film. Suitable binder resins for the coating compositions of the present invention are those having the characteristics described above and are readily identifiable by those skilled in the paint and coating arts and include cellulosic binders such as cellulose nitrate, ethyl cellulose, cellulose acetate, cellulose acetate butyrate, methyl cellulose, and the like.

Where improved adhesion to metal is desired, oxidizing types of alkyd resins are indicated. These commonly used "short, medium and long" alkyd resins are described in the scientific literature by their length and their source of origin. They include "short" alkyd resins such as castor-oil alkyd, soya alkyd, linseed-C.W.O phenolated alkyd, stryenated alkyd, coconut-oil alkyd; "medium" alkyd resins such as linseed modified alkyd oil-free alkyd, soya-linseed alkyd; and "Hi-Drink" soya-tung alkyd.

Alkyd resins derived from linseed-, soya-, coconut-, and dehydrated castor oil-alkyds, and alkyds from other vegetable sources, are suitable selections. Natural gum resins for use as additional resin film fortifiers to improve adhesion include maleic, elelmi, dammar and shellac. The blending of cellulosic and acrylic resins with alkyds as a plasticizer provides a greatly enlarged number of workable combinations. When hard organic natural resins further replace some the alkyd solids, an even greater range of formulations is possible.

The following representative coating formulations containing molybdenum disulfide are provided for illustrative purposes only, and should not be read as limiting the scope of the present invention.

Formulation 1

Cellulosic Based

| | |
|---|---|
| Molybdenum disulfide (2–6μ average particle size) | 5.5–11.0 lb (2.5–5.0 kg) |
| ½ Sec. Cellulose nitrate (75% N.V. in ethanol) | 160 lb (75.6 kg) |
| Toluene or xylenes | 245 lb (111.1 kg) |
| Dibutyl phthalate | 53 lb (24.0 kg) |
| Ethyl acetate | 157 lb (71.2 kg) |
| Butyl acetate | 109 lb (49.4 kg) |
| Butanol | 101 lb (45.8 kg) |
| Commercial shellac solution | 69 lb (31.3 kg) |

Formulation 2

Cellulosic Based

| | |
|---|---|
| Molybdenum disulfide (2–6μ average particle size) | 0.5–1.2 lb (0.23–0.54 kg) |
| Cellulose nitrate laquer | 1 Gallon (3.79 L) |

Formulation 3

Cellulosic Based

| | |
|---|---|
| Molybdenum disulfide (2–6μ average particle size) | 0.5–1.2 lb (0.23–0.54 kg) |
| Ethyl cellulose laquer | 1 Gallon (3.79 L) |

Formulation 4

Cellulosic Based

| | |
|---|---|
| Molybdenum disulfide (2–6μ average particle size) | 0.5–1.2 lb (0.23–0.54 kg) |
| Cellulose acetate/butyrate laquer | 1 Gallon (3.79 L) |

Formulation 5

Cellulosic Based Blend

| | |
|---|---|
| Molybdenum disulfide (2–6μ average particle size) Mixed with 1 gallon (3.79 L) of a carrier comprising: | 0.5–1.2 lb (0.23–0.54 kg) |
| Cellulose nitrate laquer | ⅓ gallon (1.26 L) |
| Ethyl cellulose laquer | ⅓ gallon (1.26 L) |
| Cellulose acetate/butyrate Laquer | ⅓ gallon (1.26 L) |

Formulation 6

Cellulosic/Alkyd Based Blend

| | |
|---|---|
| Molybdenum disulfide (2–6μ average particle size) Mixed with 1 gallon (3.79 L) of a carrier comprising: | 0.5–1.2 lb (0.23–0.54 kg) |
| ¼ Sec. Cellulose nitrate 75% N.V. in ethanol | 15,5 parts by weight |
| Toluene (xylenes) | 37.9 parts by weight |
| Butyl acetate | 22.9 parts by weight |
| Dibutyl phthalate | 5.2 parts by weight |
| Alkyd, non-drying, 60% N.V. | 18.5 parts by weight |

Formulation 7

Alkyd Based

| | |
|---|---|
| Molybdenum disulfide (2–6μ average particle size) Mixed with 1 gallon (3.79 L) of a carrier comprising: | 0.5–1.2 lb (0.23–0.54 kg) |
| Tall oil fatty acids | 47.6 parts by weight |
| Pentaerythritol | 23.8 parts by weight |
| Phthalic anhydride | 28.6 parts by weight |

Formulation 8

Cellulosic/Acrylic Blend

| | |
|---|---|
| Molybdenum disulfide (2–6μ average particle size) Mixed with 1 gallon (3.79 L) of a carrier comprising: | 0.5–1.2 lb (0.23–0.54 kg) |
| DuPont 2044 Elvacite ® soft Solid Acrylic Solution #1 | 1.8 parts by weight |
| DuPont PD-14-P cellulose Nitrate, ½ sec. | 13.0 parts by weight |
| Methyl isobutyl ketone | 31.9 parts by weight |
| Thinner (59% toluene, 25% MIBK, 10% isopropyl alcohol, 6% Shell Cehmical Co. Penatoxone ® ) | 53.3 parts by weight |

Formulation 9

Aerosol Acrylic Based

| | |
|---|---|
| Molybdenum disulfide (2–6μ average particle size) Mixed with 1 gallon (3.79 L) of a carrier comprising: | 0.5–1.2 lb (0.23–0.54 kg) |
| DuPont Elvacite ® 6014 Acrylic Resin #3 | 17.1 parts by weight |
| Toluene | 14.9 parts by weight |
| Acetone | 13.8 parts by weight |
| Methyl isobutyl ketone | 4.6 parts by weight |
| Monsanto Poly-Solv EE acetate | 3.6 parts by weight |
| Monsanto Santicizer 160 | 1.0 part by weight |
| Propane/isobutane/heptane propellants | 45 parts by weight |

Formulation 10

Alcohol-Based Acrylic Spray

| | |
|---|---|
| Molybdenum disulfide (2–6μ average particle size) Mixed with 1 gallon (3.79 L) of a carrier comprising: | 0.5–1.2 lb (0.23–0.54 kg) |
| DuPont 2045 6016 Elvacite ® alcohol soluble acrylic resin | 10 parts by weight |
| Isopropyl alcohol | 25 parts by weight |
| n-Propyl alcohol | 40 parts by weight |
| Shell Chemical Co. Pentoxone ® | 25 parts by weight |

The above composition holds the molybdenum disulfide in suspension for the requisite time to permit the composition to be applied to any suitable surface for creating a conditioning layer on the respective surface.

Articles may be coated with the above compositions, for example, by airless spraying, air-assisted spraying, air brush, spray pumper, wicking or wiping, brushing as with a paint brush, dip coating, immersion, quenching, tumbling, augering and the like. Virtually any application method may be used to bring the liquid composition into contact with the surface to be coated, and thereby conditioned, with molybdenum disulfide composition.

In a preferred method of applying the coating formulations of the invention, suitable propellants may be added to the above combination of molybdenum disulfide and suspending liquids, permitting the application of the suspended molybdenum disulfide from an aerosol can. To that end, suitable propellant(s) may be added to the above compositions, for example in the amounts of 5–10 parts by weight heptane, 5–10 parts by weight propane, and 20–25 parts by weight isobutane. Such combination is quite suitable for applying a conditioning coating of molybdenum disulfide of the invention to surfaces of a wide variety of substrates including lead and copper-clad bullets; fully loaded cartridges; lead shot; and rifle, shotgun, and handgun bores.

In the manufacture of bullets and bullet jackets made from lead wire, copper wire, etc., preferably the molybdenum disulfide suspension is applied to the wire after the wire has been heated to 120° F. (~48° C.) or more by being first drawn through a reducing die. Subsequent applications of the composition may be made, as needed to achieve the desired effective coating, before or after transit through subsequent drawing, reducing, forming, or swaging dies. The beneficial effects of applying the molybdenum composition in the first stages of drawing the wire, the bullet or the bullet jacket operations are:

1) The molybdenum disulfide composition is most quickly, efficiently and economically applied in the manufacturing line/process without labor expense.
2) The presence of the molybdenum composition on the substrate wire surface will prevent the oxidation of the lead and copper wire and thus prevent the accumulation of unwanted contaminants (dirt, dust, grit, etc.) thus eliminating the otherwise necessary steps of cleaning the wire or scrapping contaminated manufacturing materials.
3) The presence of the molybdenum disulfide composition on the wire will minimize/eliminate the rending, tearing, splitting, and pitting of the substrate surface which are a typical negative conditions found in the drawing/reducing/forming process. The surface coating of the molybdenum disulfide composition will appear to be uniformly smooth after the drawing through the dies. On the microscopic level, the substrate surface will be relatively very more uniform, more intact, and smooth with few rough asperites, splits, tears, and pitting.
4) The bearing, contact surfaces of the ferrous reducing/forming dies will be hardened by the formation of a thin intermetallic zone of molybdenum carbides, chromium carbides and ferrous carbides on the die surface.

The molybdenum disulfide composition coated and conditioned wire may also be used as the core of jacketed bullets. Lead wire so conditioned will be free of oxides and will be smoother, thus eliminating cleaning or scrapping of otherwise unusable lead wire. The lead wire cores will be relatively free of surface flaws and irregularities. The wire will process through cutting, shaping, swaging, forming dies better than unconditioned wire.

In the manufacture of bullet jackets, the present invention contemplates application of the molybdenum disulfide composition to the substrate surface early in the manufacturing process. The composition should be initially applied during or shortly after the rolling of the sheet copper at the mill. This factory-applied coating of the copper sheet will protect the newly formed copper from oxidation and contamination. This coating may/may not be burnished into the substrate surface in such quantities that the coating will be present through subsequent operations.

Copper bullet jackets are typically stamped out of the sheet copper by presses. They are then forwarded to punch presses where the 'billets' are drawn into 'cups' (pre-bullet jackets) or 'jackets'. It is contemplated by the present invention that the suspension be applied to the copper cups/jackets as they are drawn or formed into shape. The resulting surface of the copper cup will be more uniform, smooth and relatively free of microscopic irregularities and flaws. The forming dies etc. will be hardened as described above for the wire drawing dies. The molybdenum disulfide composition may be applied in line without labor. The resulting product is a molybdenum disulfide-conditioned bullet jacket ready for the insertion of the lead core and shaping in the swaging/forming die. The result of the swaging/forming operation is the finished molybdenum disulfide conditioned bullet. A final application of the composition may be necessary for a complete, uniform, unmarked and attractive coating.

In the manufacture of cast bullets, the present invention contemplates coating and conditioning the interior surface of bullet casting molds with the molybdenum disulfide composition of the invention to 1) provide a mold release agent for the bullets, 2) to smooth the casting surface and thereby smooth the surface of the finished cast bullet, and 3) to transfer a portion of the molybdenum disulfide residing on the mold surface to the surface of the molded bullets.

For applying the above molybdenum suspension to produce coated bullets as shown in FIG. 1, the bullets 32 may be arranged in an array, and held in such array by an organizer 22 as illustrated in FIG. 13. As illustrated in FIG. 13, organizer 22 is a sheet of a resilient, soft material such as polyethylene foam having an array of holes 24 extending therethrough from the top surface 26 to the bottom surface 28 of the organizer. The foam material is selected in terms of softness and resilience, and the holes are appropriately sized, such that a variety of sizes of bullets 10 can be inserted into the respective holes. The array of bullets in the organizer 22 are thus suitably presented for spray application of the conditioning molybdenum disulfide suspension to the bullets. The holes 24 are large enough that larger size bullets can be placed upright in the holes on a suitable shield 30 larger than the organizer, similar to placing an article to be spray-painted on a suitable shield to catch the overspray of paint. The bullets are suitably supported against falling over while the array is being set up. When the array of bullets is properly set up, and with the bullets confined within the holes, but not gripped by the sidewalls, organizer 22 is lifted carefully up and out of the array. The bullets are thus arranged in the array on the spray shield, with the organizer removed from the array.

The above liquid coating composition containing molybdenum disulfide is then spray applied to the bullets as a sweeping spray from a suitable aerosol container, much like spray applying paint from an aerosol container. Since the molybdenum disulfide is a suspension, not a solution, the user first shakes the can to disperse the solid particles, much like shaking a can of spray paint to disperse the pigment particles therein.

The shield catches the overspray. The organizer is then rotated about a vertical axis, for example 180 degrees, or the person applying the spray can move around the array, to present what was the back side of the bullets as previously sprayed, and the bullets are again sprayed. Additional sprays may be applied at e.g. 90 and 270 degrees if desired, to provide a uniform coating to the bullets.

As each spray application is applied to the bullets, between the rotations, the liquid is deposited in a relatively uniform coating on of each of the sprayed bullets. In the case of loaded cartridges, the organizer may be kept in place during the spraying step. The coating quickly coalesces such that the coating is generally unitary as respects that particular application of the suspension liquid. The liquid carrier then evaporates, leaving a dry coating of substantially pure (e.g. 97–99% pure) molybdenum disulfide composition in direct contact with the underlying substrate surface.

A surface temperature of 120° F. (~49° C.) to 180° F. (~82° C.) is preferred for application to bullets. The bullets can conveniently be warmed prior to application of the spray composition by solar radiation, an electric hair dryer or hot air gun, the use of heat lamps, or heating the bullets in a common kitchen stove oven etc. This heating is to provide a simple method of assuring that the composition will dry in place producing a thin, even coating without any running or weeping of the material.

So long as the bullets are generally clean, no degreasing of the bullets is necessary. Accordingly, while choosing to not be bound by theory, it is contemplated that the volatile solvents contained in the liquid carrier materials are effective to quickly dissolve any small amount of grease, oil, or the like, prior to evaporating from the substrate surface, and thus to remove such oil or grease material.

It has been observed that the molybdenum disulfide composition of the present invention is generally compatible with the various lubricants found on lead centerfire and rimfire bullets. The composition is sprayed over the existing lubricant and produces superior results over such lubricated bullets. Using the method of the present invention, bullet manufactures can easily blend molybdenum disulfide into their current lubricant coating and apply the molybdenum disulfide enriched lubricant using their current method of application. Generally, the amount of molybdenum disulfide added to existing lubes or anti-corrosion coatings will be in the general formulation of ½ to 3 lbs. of molybdenum disulfide per gallon of binder/vehicle/lubricant composition.

By applying a small series of coating sprays to the array of bullets in the organizer, from different angles, the bullets are generally uniformly coated with a suitable coating of molybdenum disulfide, typically about 0.0005 inch (0.013 mm) thick, with general range of thicknesses of about 0.0002 inch (0.005 mm) to about 0.001 inch (0.025 mm) per spray pass. Multiple spray passes can be used to achieve coating thickness as desired.

The coating as applied from liquid suspension does not flake off, nor does the coating generally rub off into a user's hands. Accordingly, contrary to dry-applied molybdenum disulfide coatings, the liquid-applied composition of the invention displays a stronger tendency to remain on the substrate surface. Again while choosing to not be bound by theory, applicant contemplates that the molybdenum disulfide particles in the composition coalesce with each other as the liquid carrier materials evaporate.

Thus, the orientation and dispersion of the molybdenum disulfide particles creates a layer that not only bridges the peaks of the underlying substrate, the molybdenum disulfide also generally fills in the intervening valleys. Accordingly, the molybdenum disulfide layer is generally thinner at the peaks and thicker in the valleys, thereby to present an external surface made up entirely of molybdenum disulfide composition, and wherein the external surface is overall smoother than the underlying surface of the underlying metal substrate. Further, since the molybdenum disulfide particles are arranged in the conditioning layer in generally random orientations, the particles generally work to interlock each other into the layer, thereby to strengthen the overall integrity of the conditioning layer.

While the above discussion teaches aerosol spray-applying the molybdenum suspension to bullets, the suspension can as well be applied by dip-coating the bullets in a container of such material, so long as the material is subjected to suitable agitation to maintain a generally uniform such suspension long enough to complete the desired dip-coating. A single dipping is generally suitable to apply a layer of suitable thickness to the bullets.

The dip coating method is particularly suitable for coating cartridges wherein the bullet has already been assembled to the casing, including the filling therein of the propellant, and installation of the primer. An advantage of dip coating the fully assembled cartridge is that one can simultaneously coat the bullet and the neck of the cartridge. Using such method, the coating on the bullet is effectively used along the length of the barrel of the gun, while the coating on the neck treats, conditions the shoulder of the firing chamber. Such cartridges e.g. with explosive primer and propellant are, of course, not suitable for "tumbling" as in the method taught in Martin U.S. Pat. No. 4,454,175.

Where spraying is the preferred method of application, but where sensitivity to release of aerosol propellant into the air suggests rejecting use of aerosol, the above liquid suspension can be applied by a wide variety of known conventional air or airless non-aerosol spray equipment.

While the above discussion teaches aerosol spray-applying the molybdenum suspension to bullets etc., the composition can as well be applied by dip-coating or quenching (shot) in a container of such material, so long as the material is subjected to suitable agitation to maintain a generally uniform such suspension long enough to complete the desired dip-coating or quenching. The shot may also be coated with the direct spray method.

In another embodiment of the invention, lead shot is coated and/or conditioned with a relatively inert, non-toxic, insoluble, indigestible, stable and durable layering or coating of molybdenum disulfide composition such that it will not degrade, or be removed from the shot during the internal ballistic experience of being fired through a weapon, or react with chemical compositions in aquatic (fresh or salt water) environments or in the digestive tracts of water fowl.

The molybdenum disulfide composition coating or layers will serve as a inert buffer zone on the exterior surface of the lead shot such that unintentional ingestion by water fowl will not subject the birds and other aquatic animals to the lethal effects of lead poisoning as the molybdenum disulfide coating is impervious to digestive juices, acids, enzymes, bile, etc. and impervious to environmental corrosives (e.g. salt water) and solvents. The unintentional lead poisoning of water fowl and aquatic fauna will thus be prevented. The molybdenum disulfide composition coating of the present invention is thus a very suitable coating for reasons of environmental, conservation and hunting concerns.

To coat the shot, it is sprayed while optionally being moved on an oscillating or vibrating surface or on a conveyance. In this way, the entire surface of the shot is exposed to the spray resulting in a relatively even and substantial coating of desired thickness.

In addition to their use in coating firearm projectiles with a uniform coating of molybdenum disulfide, the formulations of the invention may be employed to coat and ballistically condition the bore of a firearm barrel. In this embodiment of the invention, the liquid composition may be applied to the inside surface of the barrel by spraying or pouring a suitable stream of the liquid composition into an upstanding barrel of the gun, and catching excess flow-through amounts, if any, at the opposing end of the barrel.

Optionally, the coated bore of the firearm is brushed with a soft bore brush to uniformly distribute the coating composition before it dries. While the molybdenum disulfide may be applied to a barrel at any stage of the life of the barrel, the conditioning coating is preferably applied as part of the process of barrel manufacture. In this way, the barrel has the advantage of the conditioning coating as shipped from the barrel manufacturer. Thus the barrel has the benefit of the conditioning material having been applied under closely controlled and reproducible conditions. Moreover, the barrel will have never experienced the harsh treatment of having a cartridge fired through it prior to having had the conditioning layer applied. Moreover, there is no need to "break in" the firearm barrel by alternate shooting and cleaning operations.

In one method of barrel manufacture contemplated by the present invention, the molybdenum disulfide conditioning layer is applied to the barrel immediately prior to the last machining step, in such a manner that the molybdenum disulfide is worked into the inner surface of the barrel during such machining step. For example, in one method of manufacture, the rifling is imparted to the inner surface of the barrel by impressing the grooves in an existing surface. In this case, application of the molybdenum disulfide coating to the barrel prior to impression of the rifling causes both the raised and depressed surfaces of the barrel rifling to be conditioned by working the molybdenum disulfide into the barrel surface by the heat and pressure generated in the rifling process. As the temperature rises, the molybdenum disulfide interacts with, and reacts with, steel, carbon, silicon and similar components of the steel to form a hardened intermetallic zone at or just below the surface of the barrel, typically between the general thickness of the conditioning layer and the general composition material of the substrate steel.

Such pre-conditioned barrels coming from the manufacturer have been effectively hardened at precisely the surface of wear, while at the same time providing a protective and conditioning coating that reduces the susceptibility of the steel structure of the barrel to being damaged by cartridges fired therethrough.

In a second method of manufacturing firearm barrels, the barrel is first drilled and then machined to remove material to form the rifling. In an alternative embodiment of the invention, a first coating of molybdenum disulfide is applied to the drilled barrel prior to the step of machining the barrel to form the rifling. This machining of the barrel to produce the rifling produces the heat required to condition the barrel by working the molybdenum disulfide into the surface layer of the barrel in those areas where metal is not removed, but removes both metal and the overlying molybdenum disulfide layer from the machined rifling grooves. A second coating of molybdenum disulfide is then applied to the inner surface of the barrel. This second coating covers the rifling grooves which were scraped clean of molybdenum disulfide as a result of the rifling process, but does not have the benefit of having been temperature-hardened into the rifling grooves. This second coating step does, however, provide a uniform layer of molybdenum disulfide completely covering the inner surface of the barrel, including the rifling grooves. The second coating provides protection of the rifling grooves against corrosion and pitting by powder and primer by-products.

Moreover, to the extent the first layer, adhering to the rifling ridges was damaged in the process of forming the rifling grooves, thus removing some of the molybdenum disulfide, the second coat covers over the scraped-off areas. The areas of non-hardened surface of the raised rifling ridges in the barrel bore will become hardened in the process of firing bullets through the barrel.

In any event, the non-hardened second coating protects the entire barrel bore from corrosion, and reduces retention of lead and deposits of other leavings of bullets which have been fired through the barrel.

A further advantage is obtained from applying a liquid coating of molybdenum disulfide to a firearm barrel in combination with machining steps used in fabricating the inner surface of the barrel. The molybdenum disulfide coating aids in the barrel fabrication process by reducing the incidence of surface cracks, holes, and other damage normally associated with such machining operations in the absence of the application of molybdenum disulfide.

Such treatment results in the substantial extension of the useful life of the barrel. While an untreated barrel has a generally accepted use life of 1500–2000 rounds for some applications, the above treatment of a barrel can result in extension of use life of the barrel to over 5000 to 8000 rounds or more.

If the barrel is not so treated by the barrel manufacturer, the use of bullets coated with molybdenum disulfide as described herein, will gradually deposit a conditioning layer of molybdenum disulfide on the inner surface of the barrel. However, such deposit on the barrel is inherently less uniform and less controlled. Further, and more important, in the process of such application by use of bullets, the barrel will have been subjected to traverse of at least a few dozen such bullets through the barrel before the barrel is effectively coated. In the process, a significant amount of "normal" wear associated with use of an uncoated barrel thus occurs before the coating conditioning effect is fully in place to protect the barrel.

In a preferred use of the invention, a barrel not previously conditioned by the manufacturer is coated before any bullets are fired through the barrel. Thus, even with the first bullet shot through the barrel, the barrel has the benefit of being protected by the molybdenum disulfide layer, thus to maximize the benefit of use of the molybdenum disulfide layer. FIG. 2 illustrates such coating layers 14 and 20 on both the bullet and the barrel.

If the barrel is not so coated by the barrel manufacturer, e.g. at the factory, the user, shooter can effectively apply a suitable such coating by directing an e.g. aerosol spray of the molybdenum disulfide composition into the barrel, preferably from both ends, in no particular order. In such case, the basic molybdenum disulfide layer will have been applied without the benefit of elevated temperature. Thus, the layer will have the desired conditioning effect of smoothing out the inner surface of the barrel, but will not yet have the effect of hardening the barrel inner surface. However, as each bullet is fired through the barrel, the temperature of the barrel in temporarily increased, such that, as more and more bullets are fired through the barrel, the barrel eventually reaches that equilibrium hardness which is associated with the reactions between the steel composition and the molybdenum disulfide. As a user option, then, the barrel may first be coated with molybdenum disulfide, and then a sufficient number of shots fired so as to reach and maintain the elevated temperature in the barrel sufficient to activate and thereby bring about the hardening reactions that create the hardened layer in the barrel.

The effects of depositing a coating of molybdenum disulfide on the inner surface of the barrel are many. First, the coating protects the barrel long-term from corrosion. The coating results in a reduced amount of residual material from the shell (e.g. powder, primer, and projectile residue) being left in the barrel after each shot, resulting in less material being available for abrading the barrel as the next projectile traverses through the barrel. Thus a further affect of the coating is less abrasion of the inner surface of the barrel. If the coating has been temperature hardened in the process of barrel manufacture, the hardening process likely results from creation of such compositions as, for example, $Mo_2C$, $Cr_4C$, $(Fe, Cr)_3C$, and/or $(Fe, Si)_3C$, or intermetallic compounds such as $Fe_3$ $Mo_2$, FeMo, $Fe_3Si_2$, or FeCr.

If the coating has not been applied by the barrel manufacturer, or the coating has been applied but not temperature hardened, then firing of bullets through the barrel progressively activates the hardening process whereby the molybdenum disulfide reacts with components of the steel in the barrel to form a hardened layer likely containing some or all of the above recited compounds.

In addition, liquid application of the molybdenum disulfide coating results in a layer which has fully distributed underlying support as opposed to the bridging coating layer (FIG. 7) which likely results from transfer of such coating material from bullets traversing the barrel.

In any event, where the above described layers 14 and 20 have been applied to both the bullet and the barrel, the interface between the bullet and barrel is, for the most part, coating-to-coating. This minimizes, if not eliminates metal-to-metal contact between the bullet and the barrel (omitting from the definition of metal-to-metal contact that contact which occurs between the coating layers 14 and 20).

Thus, the liquid compositions of the invention are useful for treating bullets, barrels (rifle, pistol, shotgun, military artillery and others), loaded rifle and shotgun shells, and shotgun plastic wads.

The composition liquids of the invention can use therein solid lubricants in addition to molybdenum disulfide, as additives, so long as a significant fraction of the suspended lubricant material is molybdenum disulfide, e.g. at least 10 percent by weight molybdenum disulfide based on the combined weights of all such solid lubricant or conditioning materials. For example, graphite, boron nitride, and the like known solid lubricants can be used. Such lubricants are generally employed for their lubricating properties, not the conditioning properties described above for molybdenum disulfide. The amount of such other solid suspended materials is no more than 90% by weight of the suspended material, preferably no more than 50% by weight. Most preferred suspension compositions comprise at least 90% by weight molybdenum disulfide as the suspended material. As in the above described composition, The molybdenum disulfide is preferred to be the only suspended material in any significant quantity.

It should be noted that in this application of molybdenum disulfide to ballistics articles such as bullets, rifle shells, rifle and shotgun barrels, shotgun shells, shotgun wads, and the like, the molybdenum disulfide appears to operate more as a surface "conditioner" than as a lubricant, as evidence by the fact that muzzle velocity of rifle bullets fired using such treatments are somewhat lower than the muzzle velocity of bullets fired without using such treatment.

The effects of coating bullets and/or the barrel as above with molybdenum disulfide are many. First, there is no concern with unintentionally creating obstructions in the barrel, as can happen when bullets are coated with grease. Coated bullets leave less fouling in the barrel. With coated bullets, muzzle velocity is reduced, typically by about 3–5%. Coated bullets fly a flatter trajectory, with greater accuracy. When bullets or the barrel, or both, are coated, barrel life is extended. The shooter can shoot more bullets between cleanings of the barrel without loss of accuracy if either the bullets or the barrel or both are coated. Cleaning the barrel is easier, taking much less time than if the bullets and/or barrel are uncoated. Coating either the bullets or the barrel will provide some benefits of the invention. However, the maximum benefits are obtained where both bullets and barrel are coated. Bullets are not damaged in the process of being coated, as can happen with the Martin '175 impact plating process. Coating of the bullets results in concurrent degreasing such that the coating adheres. The coating process of the present invention is easy to use, certain of success, and takes only a few seconds, a few minutes if counting the time to install bullets in organizer 22. No extraneous material is added to the molybdenum disulfide, whereby the coating contains no extraneous material other than the impurities normally found commercially available grades of molybdenum disulfide. The resulting coated bullets have a smoother surface than impact plated bullets because no dents have been formed by any "impacting" activity. Applicant's liquid composition can readily be applied anywhere liquid can be caused to flow, such as interior surfaces such as inside a gun barrel, or in or near the firing chamber of the gun. Using normal paint spraying application technique, an acceptable thickness layer of molybdenum disulfide can be obtained with little, if any, training or experience. The resulting product does not easily transfer the coating material off the bullet onto the user's hands. There is no risk of spillage of messy molybdenum disulfide powder. The coating can be applied to loaded cartridges.

In addition to the above benefits, when coatings of the invention are used, the rifling forms cleaner grooves in the bullets than if no coating is used. By using the liquid suspension as the vehicle for applying coatings of the invention, no wax or other vehicle need be used to retain the molybdenum disulfide layer in secure affixation to the underlying substrate surface.

The invention contemplates using spray application, whether aerosol or non-aerosol, air or airless, to apply a conditioning coating of the molybdenum disulfide suspension to the inside surface of the barrel of the gun, whether rifle or shotgun. The resulting coating on the barrel is similar in nature to the coating described for bullets. The spray may be applied from either end of the barrel, or both ends.

While the above description has concentrated so far generally on use of a molybdenum disulfide composition for coating rifle bullets, rifle barrels, and rifle shells/cartridges, the molybdenum disulfide composition and coatings made therefrom apply as well to shotgun barrels, shotgun shells including plastic side walls thereof, and shotgun wads including plastic wads.

Shotgun barrels are treated in the same manner as rifle barrels, except that shotgun barrels generally carry no rifling. Therefore an optional step of heating the coated shotgun barrel to form the hardened intermetallic zone may be required. Thus, the coating material is temperature activated in a manufacturing step other than a step of forming rifling. Shotgun shells can be coated in the entirety of their side walls, including brass and plastic. Shotgun wads can be coated in the above described spray application. The purpose for coating shotgun wadding is to reduce plastic fouling of the barrel.

The above illustrations of substrates and coatings are not intended to be limiting, but are offered as examples of the wide variety of ballistics-related substrates which may be readily, easily and assuredly coated with molybdenum disulfide and with which the invention can be utilized.

In view of the above, it is now clear that the invention may advantageously be applied to any ballistics article where there is high speed, high temperature interaction between solid surfaces, one of which is metal.

Thus, in the typical, and preferred embodiment of the invention, the gun barrel is liquid coated and temperature activated before even one shot is fired through the barrel. In addition, all bullets fired through the barrel are liquid coated, thereby to provide coating-to-coating interaction between bullet and barrel, and replenishment of coating material from bullet to barrel as any coating material wears off the inside of the barrel.

In view of the above disclosure and description, those skilled in the art can now see that certain modifications can be made to the articles and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the invention as herein described.

I claim:

1. A composition for ballistic conditioning of firearms, firearm components, and firearm projectiles consisting essentially of a suspension of from 10–100% by weight of powdered molybdenum disulfide and from 0–90% by weight of a solid lubricant selected from graphite and boron nitride in a carrier comprising a volatile solvent and a binder selected from the group consisting of quick-drying cellulosic, alkyd, and acrylic resins, and mixtures thereof.

2. A composition according to claim 1 wherein said powdered molybdenum disulfide has an average particle size less than about 8 microns.

3. A composition according to claim 1 wherein said binder is selected from the group consisting of quick-drying cellulosic resins.

4. A composition according to claim 1 wherein said binder is selected from the group consisting of quick-drying alkyd resins.

5. A composition according to claim 1 wherein said binder is selected from the group consisting of quick-drying acrylic resins.

6. A composition according to claim 1 comprising from about 0.5–1.2 lb (0.23–0.54 kg) of molybdenum disulfide per gallon (3.79 liters) of said carrier.

7. A composition according to claim 1 wherein said additional solid lubricant comprises less than about 50% of the combined weight of said solid lubricant and molybdenum disulfide.

8. A method for ballistic conditioning of bullets comprising the application to said bullets of a layer of a molybdenum disulfide composition according to claim 1.

9. The method of claim 8 wherein said method of application is by aerosol spray.

10. The method of claim 8 wherein said method of application is by airless spraying, air-assisted spraying, air brush, or spray pumper.

11. The method of claim 8 wherein said method of applying is by wicking, wiping, brushing, dip coating, or immersion.

12. The method according to claim 9 wherein said bullets are heated prior to said aerosol application of said layer of molybdenum disulfide compositions.

13. The method of claim 12 wherein said bullets are heated to a temperature of between about 120° F. (~49° C.) to about 180° F. (~82° C.) prior to said aerosol application of said layer of molybdenum disulfide compositions.

14. The method according to claim 10 wherein said bullets are heated prior to said spray application of said layer of molybdenum disulfide compositions.

15. The method of claim 14 wherein said bullets are heated to a temperature of between about 120° F. (~49° C.) to about 180° F. (~82° C.) prior to said aerosol application of said layer of molybdenum disulfide compositions.

16. The method of claim 8 wherein said layer of molybdenum disulfide coating composition is of a thickness of between about 0.0002 inch (0.005 mm) to about 0.001 inch (0.025 mm).

17. A method of ballistic conditioning of wire for swaged bullets comprising applying a layer of molybdenum disulfide composition according to claim 1 to said wire prior to a step of drawing said wire through a wire drawing die.

18. The method according to claim 17 wherein said step of applying a layer of molybdenum disulfide composition is prior to drawing the wire through a second or subsequent wire drawing die to utilize the heating caused by drawing the wire through a prior wire drawing die to assist in conditioning said wire with molybdenum disulfide.

19. A method for producing ballistic conditioning copper-clad bullets comprising applying a molybdenum disulfide composition to sheet copper prior to forming said copper sheeting into jackets for said bullets.

20. A method for ballistic conditioning of fully loaded ammunition cartridges comprising the application to said cartridges of a layer of a molybdenum disulfide composition according to claim 1.

21. The method of claim 20 wherein said method of application is by aerosol spray.

22. The method of claim 20 wherein said method of application is by airless spraying, air-assisted spraying, air brush, or spray pumper.

23. The method of claim 20 wherein said method of applying is by wicking, wiping, brushing, dip coating, or immersion.

24. The method of claim 20 wherein said layer of molybdenum disulfide coating composition is of a thickness of between about 0.0002 inch (0.005 mm) to about 0.001 inch (0.025 mm).

25. Firearm projectiles having a coating of a composition comprising molybdenum disulfide in a binder selected from cellulosic-, alkyd- or acrylic-based resins.

26. The firearm projectiles according to claim 25 wherein said coating is of a thickness of between about 0.0002 inch (0.005 mm) to about 0.001 inch (0.025 mm).

27. The projectiles according to claim 25 selected from the group consisting of lead bullets, copper-clad lead bullets, and ammunition cartridges.

28. A method of providing a corrosion protective coating on lead shot comprising applying to said shot a molybdenum disulfide composition according to claim 1.

29. Lead shot having a corrosion protective coating comprising a molybdenum disulfide composition according to claim 1.

30. A method of ballistically conditioning the bore of the barrel of a firearm comprising applying to said bore a coating of a composition comprising powdered molybdenum disulfide in a carrier comprising a volatile solvent and a binder selected from the group consisting of quick-drying cellulosic, alkyd, and acrylic resins, and mixtures thereof and thereafter heating said barrel to a temperature sufficient to cause the molybdenum disulfide to react with components of the barrel to form a hardened layer on the surface of said bore.

31. The method according to claim 30 wherein said molybdenum disulfide is of an average particle size ranging between less than about 8 microns.

32. The method according to claim 30 wherein said barrel is a rifle or handgun barrel.

33. The method of claim 32 wherein said molybdenum disulfide is applied prior to the step of forming rifling within the bore of said barrel.

34. The method of claim 33 wherein said step of forming said rifling comprises impressing said rifling upon the bore of said barrel.

35. The method of claim 33 wherein said step of forming said rifling comprises machining said bore of said barrel.

36. The step of claim 35 further comprising the step of applying one or more coatings of said molybdenum disulfide composition subsequent to said machining step.

37. The method of claim 30 wherein said step of heating comprises the firing of projectiles through the barrel of said firearm to cause the barrel to rise to a temperature sufficient to cause the molybdenum disulfide to react with components of the barrel to form a hardened layer on the surface of said bore.

38. The method of claim 37 wherein said projectiles are coated with molybdenum disulfide.

39. A firearm having a barrel with a coating on the bore thereof, said coating comprising powdered molybdenum disulfide and a binder selected from a cellulosic-, alkyd- or acrylic-resin.

* * * * *